US005715992A

United States Patent [19]

Andrews, Sr. et al.

[11] Patent Number: 5,715,992

[45] Date of Patent: Feb. 10, 1998

[54] BEVERAGE CONTAINER

[75] Inventors: Jared P. Andrews, Sr., Grand Terrace; John W. Goodin, Coto de Caza, both of Calif.

[73] Assignee: J & M Coffee Container Company, Inc., Laguna Niguel, Calif.

[21] Appl. No.: 645,218

[22] Filed: May 13, 1996

Related U.S. Application Data

[60] Provisional application No. 60/004,298 Aug. 26, 1995.

[51] Int. Cl.[6] ..... B65D 5/74

[52] U.S. Cl. ..... 229/125.15; 53/469; 220/465; 229/104; 229/112

[58] Field of Search ..... 220/460, 465; 229/104, 112, 117.15, 125.15; 53/469, 471

[56] References Cited

U.S. PATENT DOCUMENTS

| | | |
|---|---|---|
| 2,574,931 | 11/1951 | Nason, Jr. . |
| 2,618,409 | 11/1952 | Eisenberger et al. . |
| 3,143,249 | 8/1964 | Merrill et al. . |
| 3,163,544 | 12/1964 | Valyi . |
| 3,227,322 | 1/1966 | Crain . |
| 3,233,817 | 2/1966 | Casady . |
| 3,363,807 | 1/1968 | Powell . |
| 3,931,916 | 1/1976 | Blue et al. . |
| 4,375,864 | 3/1983 | Savage . |
| 4,653,671 | 3/1987 | Duffy et al. . |
| 4,781,314 | 11/1988 | Schoonover et al. . |
| 5,048,691 | 9/1991 | Heuberger et al. . |
| 5,125,566 | 6/1992 | Deiger . |
| 5,163,485 | 11/1992 | Hermann . |
| 5,169,019 | 12/1992 | Budenbender . |
| 5,392,958 | 2/1995 | Kurtzahn et al. . |

*Primary Examiner*—Gary E. Elkins

*Attorney, Agent, or Firm*—Knobbe, Martens, Olson & Bear, LLP

[57] ABSTRACT

A container including an outer shell, a flexible bag within the outer shell, a mouth and a handle. The outer shell has a top, a bottom and sidewalls. The outer shell also defines an opening. The flexible bag within the outer shell defines an aperture. The mouth is secured to said flexible bag surrounding said aperture and defines a fluid passageway. The mouth is sized and shaped such that fluid can be poured through the mouth from a source having an outlet spaced above the mouth. The handle extends outward from said top of said outer shell and has sufficient strength to provide essentially all support for said container when the bag is filled with liquid in either of two positions, with the first position being where the opening is facing upwards and the second position being where opening is facing sidewards. Desirably, the mouth and opening are sized and shaped such that when the opening is facing upwards the human eye can detect when a level of fluid in the container is approaching the mouth.

21 Claims, 6 Drawing Sheets

BEVERAGE CONTAINER

FIELD OF THE INVENTION

This invention relates to an improved beverage container. More specifically, this invention is directed to an improved container for storing and transporting several cups of fluid, such as coffee.

BACKGROUND AND SUMMARY OF THE INVENTION

Gourmet coffee shops typically sell individual cups of coffee for consumption on or off the premises. Typically, these shops are very small and utilize high-quality coffee beans and coffee-making equipment to provide consumers with a higher quality cup of coffee than would be available in other establishments. In this regard, many gourmet coffee shops have developed internal procedures particularly adapted to ensure a uniformly high-quality cup of coffee. Particularly at peak periods, these shops must dispense coffee to a relatively large group of consumers in a short amount of time. Typically, the worker holds the coffee cup below the spout and utilizes the other hand to actuate the spout until the worker sees that the coffee cup is nearly full.

Consumers accustomed to the high-quality of coffee available from such gourmet coffee shops have come to desire this high level of quality at other locations, such as offices or meeting places. Gourmet coffee shops have met this need by providing thermos canisters which are loaned out and then returned by the consumer. These canisters are often, elongate, cylindrical thermoses having a pump button in the top, which dispenses coffee from a nozzle. Unfortunately, the inconvenience of needing to return the canister and the typical requirement that a deposit be left deters consumers from purchasing larger quantities of coffee. These canisters also have several drawbacks for the coffee shop. Specifically, they are relatively large and difficult to store, are breakable and require careful cleaning after use.

Applicant's invention is an improved liquid container particularly adapted to store and insulate multiple cups of fluid. The invention includes numerous aspects. Advantageously, the preferred container is particularly adapted to be stored in a flattened state, while at the same time being quickly and easily deployable. Importantly, the container can desirably be filled with existing equipment utilizing the existing procedures utilized in most coffee shops. The container is also desirably particularly adapted to be easily carried and poured. Advantageously, the structure of the container reduces the likelihood that the container will tip over during transport and incorporates safety features which reduce the risk of injury to the user from hot coffee. Importantly, the container is also structured to reduce the risk of damage to furniture resulting from the temperature of the fluid in the container. Because the container is particularly adapted to be made of very inexpensive materials, the container need not be returned nor cleaned.

One aspect of the invention is a container including an outer shell, a flexible bag within the outer shell, a mouth and a handle. The outer shell has a top, a bottom and sidewalls. The outer shell also defines an opening. The flexible bag within the outer shell defines an aperture. The mouth is secured to the flexible bag surrounding the aperture and defines a fluid passageway. The mouth is sized and shaped such that fluid can be poured through the mouth from a source having an outlet spaced above the mouth. The handle extends outward from the top of the outer shell and has sufficient strength to provide essentially all support for the container when the bag is filled with liquid in either of two positions, with the first position being where the opening is facing upwards and the second position being where opening is facing sidewards.

Desirably, the mouth and opening are sized and shaped such that when the opening is facing upwards the human eye can detect when a level of fluid in the container is approaching the mouth. Advantageously, the mouth defines an aperture having a span of at least one inch.

In another aspect, the outer shell has a lower panel upon which the bag rests when it is filled with liquid which is spaced at least one-quarter and, preferably, one-half inch above bottom of the outer shell.

In another aspect, the bag and the outer shell are sized and shaped such that when the bag is substantially full of liquid, the center of gravity of the container is located at least one-half inch and, preferably, at least one inch, below the vertical center of the container.

Yet another aspect of the invention is a foldable liquid container, including an outer shell and a bag within the outer shell which defines an aperture. The outer shell comprises a first pair of sidewalls aligned generally in the same plane as one another and a second pair of sidewalls aligned generally in the same plane as one another. The outer shell further includes a plurality of upper end flaps secured to the first pair of sidewalls and the second pair of sidewalls. Desirably, at least one of the upper end flaps forms at least a portion of a handle when the container is folded and a plurality of lower end flaps secured to the first pair of sidewalls and the second pair of sidewalls. The outer shell also defines an opening in one of the pairs of sidewalls. The mouth is secured to the flexible bag surrounding the aperture and defines a fluid passageway. The mouth is sized and shaped such that fluid can be poured through the mouth from a source having an outlet spaced above the mouth.

Another aspect of the invention is a liquid container including an outer shell having a top and a bottom, the outer shell having an opening on a side of the container, a flexible bag within the outer shell, a mouth secured to the flexible bag surrounding the aperture and defining a fluid passageway and a handle extending from the top of the outer shell, the bag sized and shaped such that when the bag is filled with a fluid to a first level proximate the mouth when the mouth is facing upwards and the container is rotated to rest on the bottom, the fluid assumes a second level below the mouth. Desirably, the bag and the outer shell are sized and shaped such that when the bag is substantially full of liquid, the center of gravity of the container is located at least one inch below the center of the container.

Desirably, the bag is sized smaller than the outer shell so that when the container is rotated after filling to have the handle facing upwards and the spout facing the side, the bag sags downward within the outer shell, setting the level of fluid in the bag below the bottom of the spout. By ensuring that the level of fluid is below the spout, the present invention prevents accidental spillage of hot fluid during transport or handling of the container. Advantageously, the top side of the container ramps upward in an incline from the back side panel to the front side panel with the opening for the spout. Such a design facilitates dispensing fluid from the container when a user grips the handle and rotates the container forward to raise the level of the fluid to the spout. Other aspects of the invention include an improved liquid container for chilling fluid and an improved liquid container for storing and mixing dried flavor crystals with liquid.

An advantage of the present invention is that it can be stored flat and stacked in piles, thereby conserving large amounts of space in stores that sell coffee to go. Further, the container can be quickly folded together by using the fold-over flaps to assemble the top and bottom sides of the cardboard container.

Another aspect of the invention is a method of using a collapsed liquid container including (1) folding the container so that the container defines a top from which a handle extends, a bottom and a mouth defining a fluid flow path communicating with an interior of the container through a sidewall; (2) placing the container in a first position with the sidewall facing upward; (3) pouring fluid through the mouth into the container to at least partially fill the container with fluid; (4) sealing the mouth after the pouring of fluid into the container; and (5) manually grasping the handle to move the container after the sealing.

In its preferred embodiment, the present invention overcomes a variety of key problems in the prior art since it provides an easily deployable, inexpensive yet safe means for carrying, insulating, storing and dispensing hot fluids which conserves storage space and can be disposed of after use.

BRIEF DESCRIPTION OF THE DRAWINGS

The preferred embodiments of this invention, illustrating its features, will now be discussed in detail. The drawings depict a preferred beverage container for illustrative purposes only. These drawings include the following figures, with like numerals indicating like parts.

DETAILED DESCRIPTION OF THE PREFERRED EMBODIMENT

Figure 1:
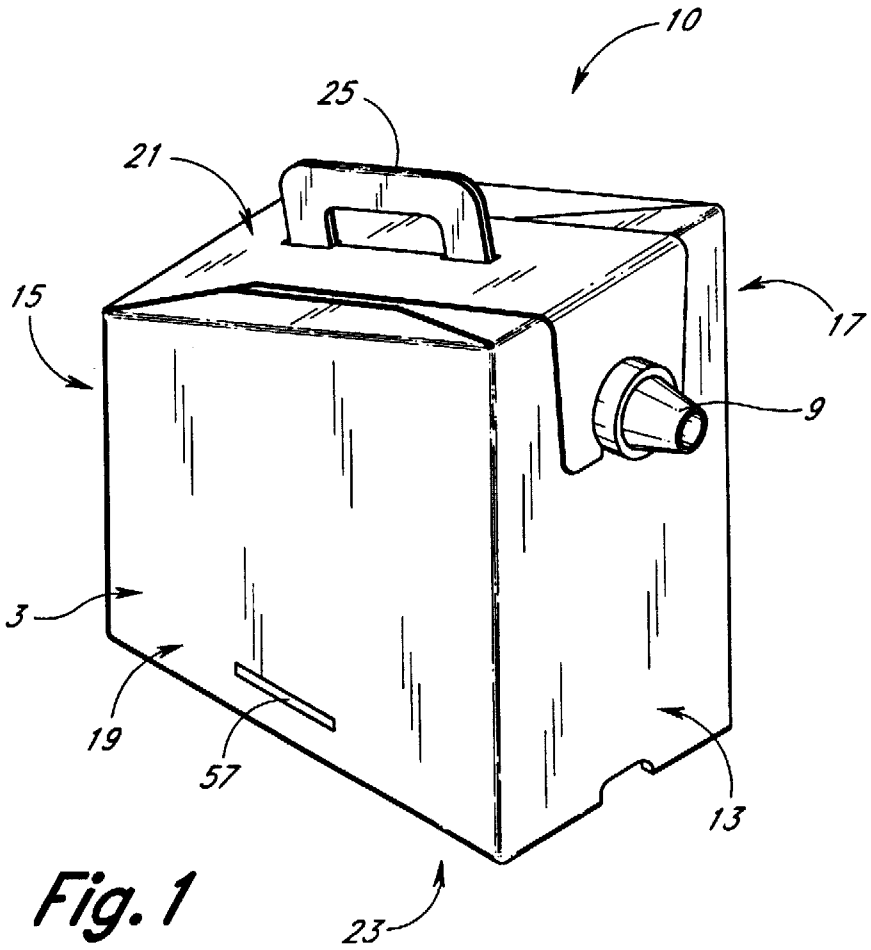
FIG. 1 is a perspective view of the beverage container of the present invention.

FIG. 1 illustrates a perspective view of a preferred beverage container 10 in its assembled form. Referring to FIGS. 1–6, the container 10 includes an outer container or shell 3, an inner bag 5, a mouth 7 and a spout 9. The bag 5 is positioned within the outer shell 3 and communicates with the exterior of the container 10 by means of the mouth 7 and spout 9. The container 10 has a front 13, a back 15, a left side 17, a right side 19, a top 21 and a bottom 23. In addition, the container advantageously defines a handle 25.

Figure 2:
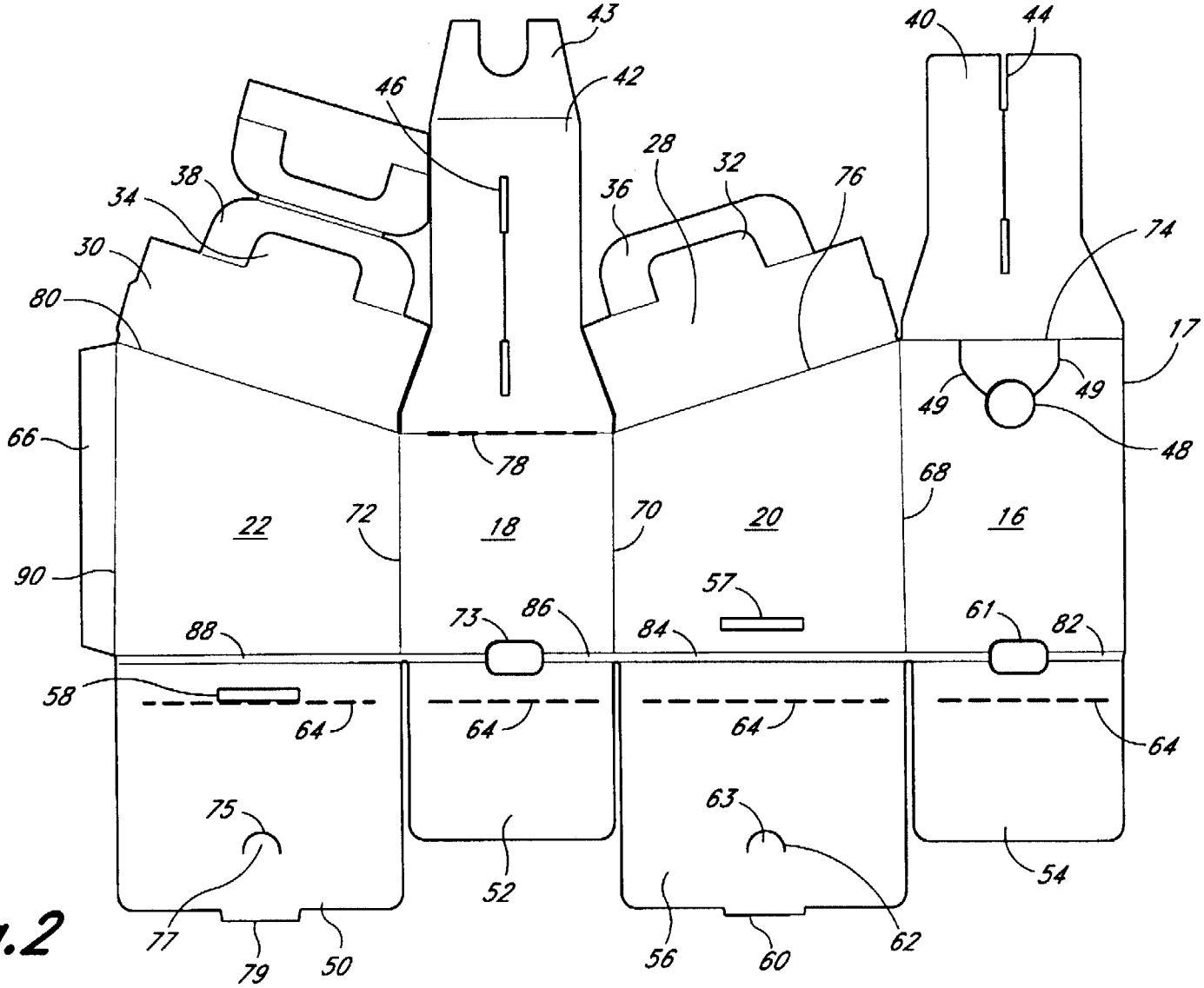
FIG. 2 is a top plan view of a blank from which the outer shell of the present invention is manufactured.

As seen in FIG. 2, the outer shell 3 is advantageously configured to be constructed from a single one-piece cardboard blank. The shell has a front wall panel 16, a back wall panel 18, a right side wall panel 20, a left side wall panel 22 and a side attachment tab 66. The front wall panel 16 defines a circular opening 48 and tapered slits 49. The front wall panel 16 is hingedly attached along a right front fold line 68 to right side wall panel 20. Opposite the right front fold line 68, the right side panel 20 is hingedly attached to the back wall panel 18 along a right back right back fold line 70. The right wall panel further defines a lower slot 57. Opposite the right back fold line 70, the back wall panel 18 is hingedly attached to the left wall panel 22 along a left back fold line 72. Opposite the left back fold line 72, the attachment tab is attached to the left wall panel 22 along a left front fold line 90.

The blank further incorporates a series of top flaps and a series of bottom flaps. The top flaps include a top front flap 40, a top right handle flap 28, a top back flap 42 and a top left handle flap 30. The bottom flaps include a front bottom flap 54, right bottom flap 56, a back bottom flap 52 and a left bottom flap 50. The front wall panel 16 is hingedly secured along a top front fold line 74 to the top front flap 40, and also hingedly secured along a double bottom front fold line 82 to a bottom front flap 54. The double fold line facilitates the folding of the blank against itself along the double fold line, as is well-known in the art. The opening 48 is defined within the front wall panel 16 in close proximity to the top front fold line 74. The top front flap 40 defines an open-ended slot 44 extending to a distal edge of top front flap 40. The front wall panel 16 and bottom front flap 54 cooperate to define a front air aperture 61 along the bottom front fold line 82.

The right side panel 20 is hingedly coupled along a top right fold line 76 to top right handle flap 28 and is also hingedly secured along a double bottom right fold line 84 to a bottom right flap 56. The top right handle flap 28 includes a right handle portion 36 and a right tab portion 32. The bottom right flap 56 defines a small, generally semi-circular slit 63 which forms a finger flap 63. The bottom right flap 56 also defines a tab 60 extending from a distal edge of the bottom right flap 56.

The back side wall panel 18 is hingedly secured along a top back fold line 78 to the top back flap 42 and also hingedly secured along a double bottom back fold line 86 to the bottom back flap 52. The back wall panel 18 and bottom back flap 55 cooperate to define a back air aperture 73 along the bottom back fold line 86. The top back flap 42 includes a closed slot 46 and a generally U-shaped distal locking portion 43. The left side wall panel is hingedly secured along a top left fold line 80 to the top left handle flap 30 and hingedly secured along a double bottom left fold line 88 to the bottom left flap 50.

The top left handle flap 30 includes a double left handle portion 38 and a pair of left tab portions 34 which are formed by cutouts to define an opening underneath the left handle portion 38. Each of the bottom flaps 50, 52, 54 and 56 further defines a spacer fold line 64 approximately one-half inch from its respective wall panel 22, 18, 16 and 20. Directly above the fold line 64 on the bottom left flap 50 is a slot 58 sized for receiving the tab 60 of bottom right flap 56 when the container 11 is assembled. The fold line 64 along bottom left flap 50 further defines a left spacer strip 65 of the bottom left flap 50 that is defined by the parallel fold lines 64 and 82. The bottom left flap 50 defines a small, generally semi-circular slit 75 which forms a finger flap 77. The bottom left flap 50 also defines a tab 79 extending from a distal edge of the bottom right flap 50.

Figure 7:
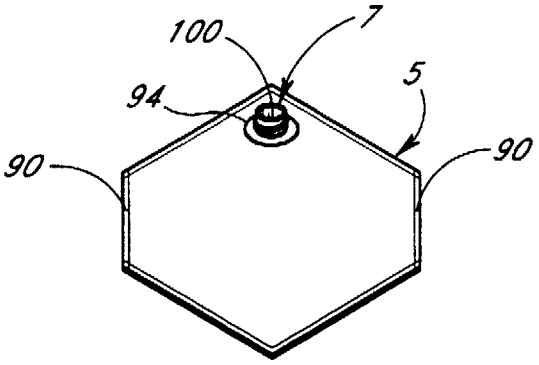
FIG. 7 is a perspective view of the bag and mouth of the container of FIG. 1.

Advantageously, prior to connecting the side tab 66, extending from the left side panel 22 to the front side wall 16, the bag 5 is connected to the outer shell 3. In the preferred embodiment, the bag 5 comprises several layers, having an inside taste-neutral layer that imparts no flavor, a middle layer that insulates the heat of the liquid, and an outer layer for providing strength and flexibility. Such bags are available from Scholle Corporation, having a manufacturing facility in Rancho Dominguez, Calif. Desirably, the bag can be constructed from flat sheets, which are heat sealed and cut to form the desired shape. Referring to FIG. 7, in the preferred embodiment, the bag 5 is generally 13½ inches by 13½ inches, sealed along its entire perimeter and has vertically oriented dart seals 90 (as shown in FIG. 7) which form isoceles triangle shaped cutouts having equal sides of 4 inches along the perimeter of the bag 5 at the corners on either side of the mouth 7. The mouth 7 has a generally cylindrical body 92 with an annular outer rim 94 at one end which is bonded to the bag 5 by an appropriate adhesive or other means known in the art, and external threads 96 at the other end. The body 92 is desirably provided with a of raised annular ring spaced slightly from the outer rim 94 which forms an annular groove. The body 92 of the mouth 7 further defines a generally cylindrical internal channel 100. The mouth 7 is advantageously sized and shaped for the external threads 96 and raised annular ring to be slightly larger than the opening 48 in the front wall panel 16 of the outer shell 3. The slits 49 in the front wall panel 16 facilitate the their insertion through the opening 48. Thus positioned, the mouth is secured within the outer shell 3 by the outer rim 94. The bag 5 may also be more securely retained in position within the outer shell 3 by means of adhesive between the rim 94 and the interior of the front wall panel 16 surrounding the opening 48. The bag 5 is desirably inserted into the outer shell 3 with its cutout corners and the corner opposite the mouth folded up and inward toward the center of the bag.

Figure 4C:
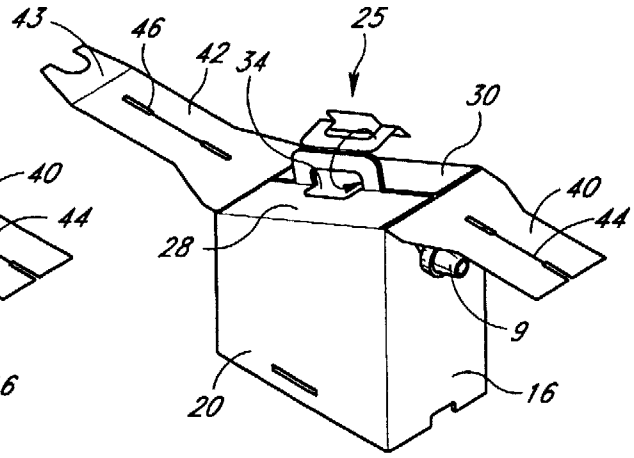
FIGS. 4*a–f* are perspective views illustrating the formation of the top of the beverage container of the present invention.
Figure 4B:
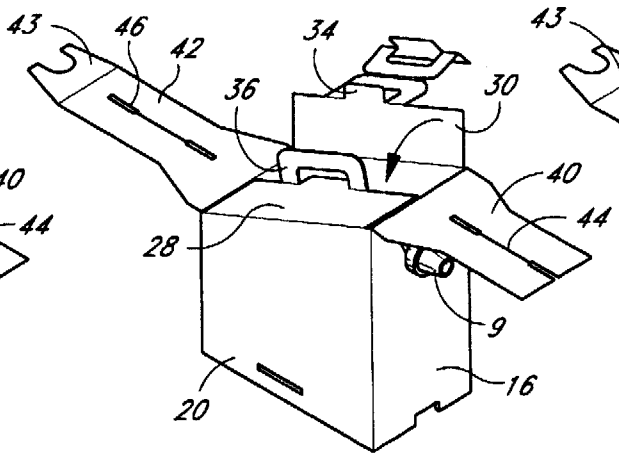
Figure 4A:
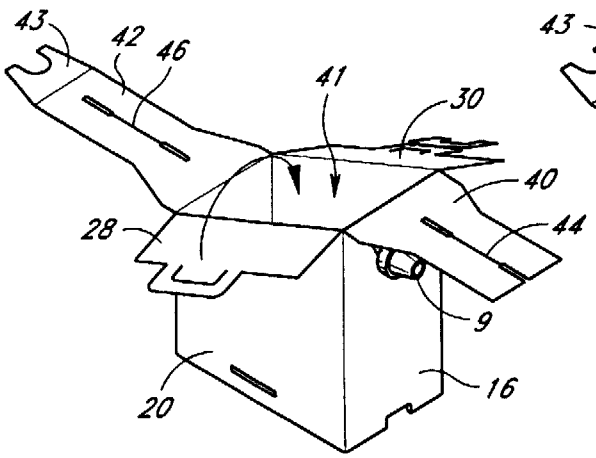
Figure 4F:
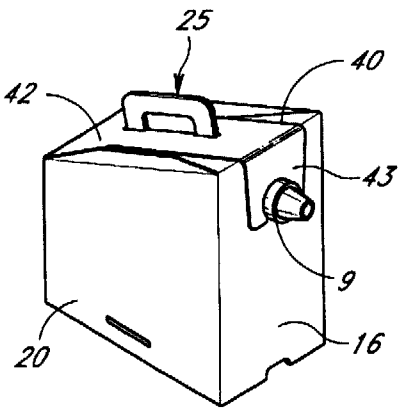
Figure 4E:
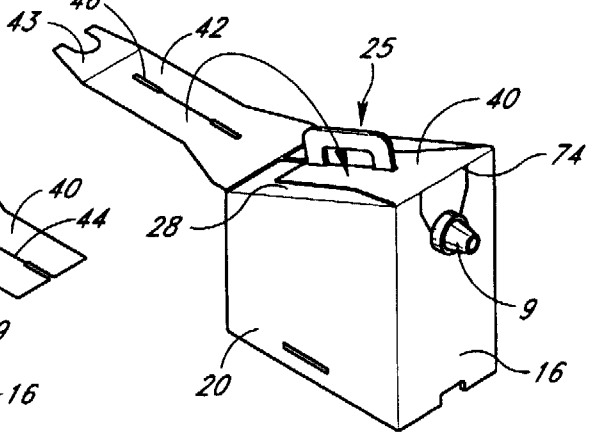
Figure 4D:
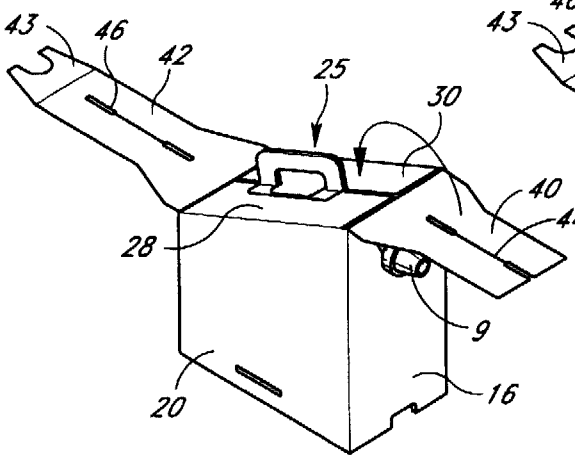
Figure 5B:
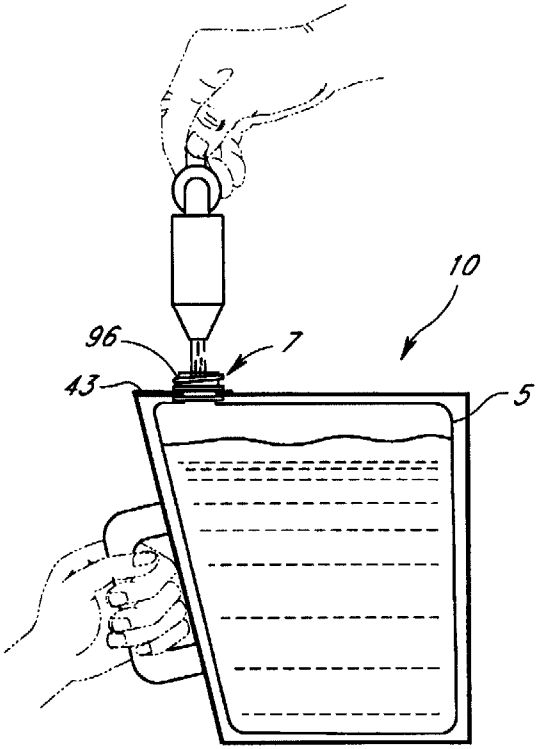
FIGS. 5*a–b* are cross-sectional front views illustrating the filling of the bag of the beverage container of the present invention.
Figure 5A:
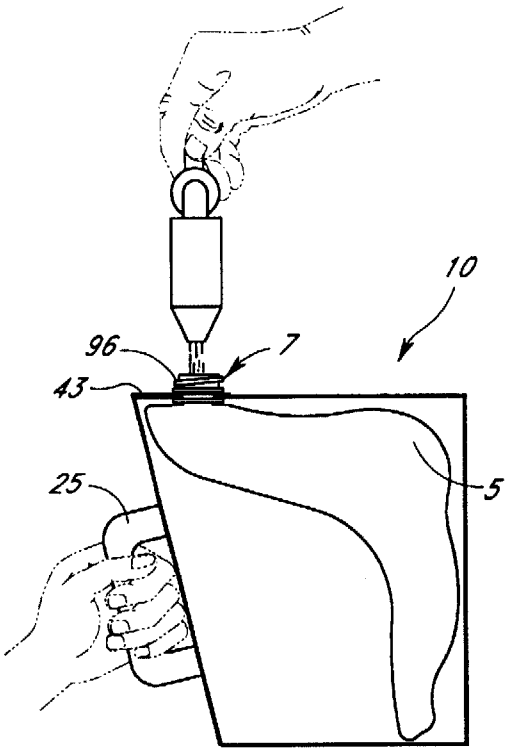
Figure 5C:
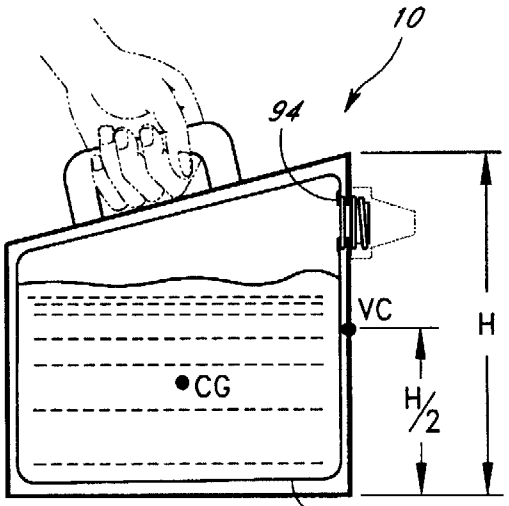
FIG. 5*c* is a cross-sectional side view illustrating the container of the present invention rotated 90° with respect to the FIGS. 5*a–b*.

Referring to FIGS. 4 and 5, the spout 9 of the container will now be described. The spout is desirably conical in shape and is internally threaded to mate with the mouth 7. For convenience, the mouth may include a tear-off portion for sealing the container, until the destination is reached.

Figure 6:
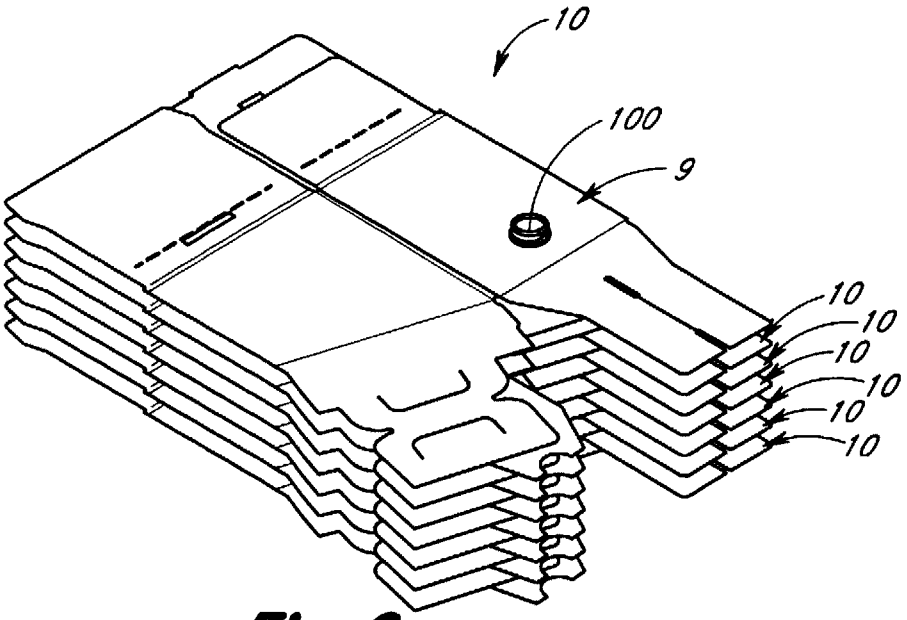
FIG. 6 is a perspective view of several beverage containers of the present invention stacked in collapsed form.

The tab 66 of the left side wall panel 22 is fastened to the front side wall panel 16 along an edge 17 of the front side wall 16 opposite of the right front fold line 68. The fastening may be accomplished by double sided adhesive, glue or other fastening means known to those of skill in the art. Upon fastening, the outer shell 3 may then be laid and stored flattened with two adjacent side wall panels, panels 16 and 20 for example, facing upwards, and the other two side wall panels, panels 18 and 22, facing downwards. The outer shell is thus ready for quick assembly and may be stored efficiently in stacks as illustrated in FIG. 6. Advantageously, the spout 9 is threaded onto the mouth after the container has been filled.

Figure 3B:
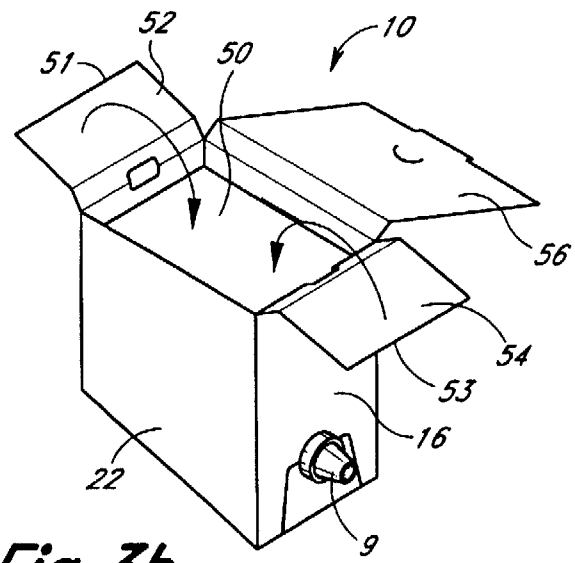
FIGS. 3*a–d* are perspective views illustrating the formation of the bottom of the beverage container of the present invention.

The assembly of the container 10 will now be described. FIGS. 3*a–d* illustrates the assembly of the bottom of the outer shell 3. FIG. 3*a* shows the container 10 turned over so that the bottom flaps 50, 52, 54, and 56 are facing upwards and the side wall panels 16, 18, 20, and 22, folded to form a substantially rectangular opening 55. In this position, the front side wall panel 16 is folded along left front fold line 90 so that the front side wall panel is perpendicular to the left side wall panel 22. The front wall panel 16 is also oriented perpendicularly with respect to right side wall panel 20 along right front fold line 68, so that left side wall panel 22 and right side wall panel 20 are parallel to each other. The back wall panel 18 is folded along the left back fold line 72 to be perpendicular to the left side wall panel 22, and is also folded along the right back fold line 70 to be perpendicular to the right side wall panel 20. The back wall panel 18 is thus parallel to the front wall panel 16.

FIG. 3*a* indicates that the bottom left flap 50, which is secured to the left side wall panel along bottom left fold line 88, is the first flap that is folded over and is folded along the bottom front fold line 88 into the opening 55. When the bottom left flap 50 is turned over, the left spacer strip 65 is folded down against the interior of left side wall panel 22, the tab 79 extends through slot 57 in the right side panel 20 and the distal edge of the bottom left flap 50 contacts the interior of right side wall panel 20 as shown in FIG. 3*b*. The bottom left flap 50, with the exception of the spacer strip 65 is thus oriented perpendicularly to the wall panels 16, 18, 20, and 22, and is recessed below the bottom left fold line 88.

Figure 3D:
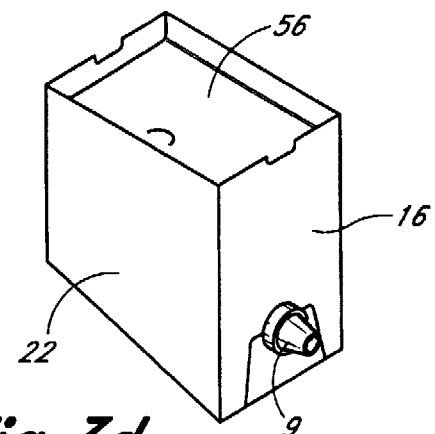
Figure 3A:
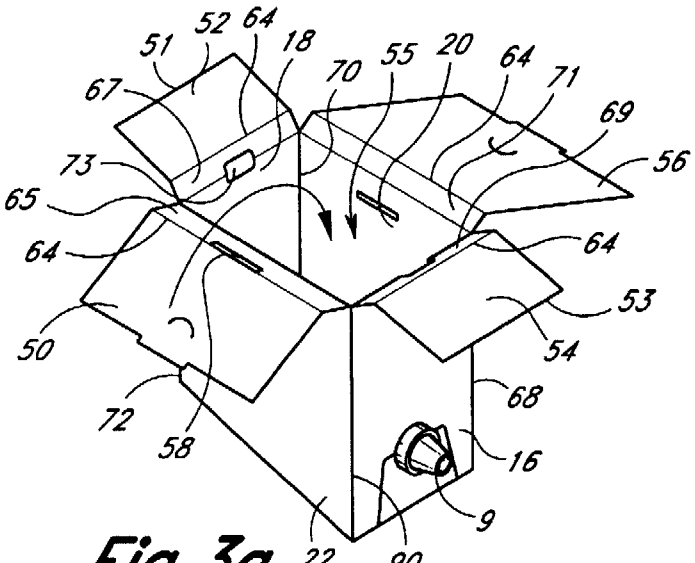
Figure 3C:
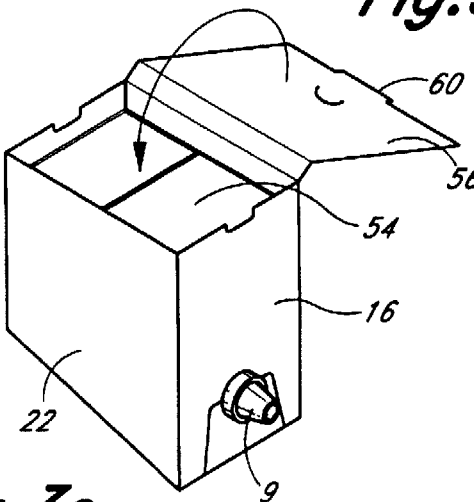

FIGS. 3*b* and 3*c* indicate that the bottom back flap 52 and bottom front flap 54, which are secured to the back wall panel 18 and the front wall panel 16, respectively, are then folded over on top of the bottom left flap 50 about their respective bottom fold lines 86 and 82. As with the bottom left flap 50, the back spacer strip 67 of the bottom back flap 52 and the front spacer strip 69 of the bottom front flap 54 are folded down along the fold line 64 against the interior of the back wall panel 18 and the interior of the front wall panel 16, respectively. When the bottom flaps 52 and 54 are folded over onto bottom left flap 50, the edge 51 of the bottom back flap 52 meets with the edge 53 of the bottom front flap 54 to create a second layer of cardboard on top of the first layer, the bottom left flap 50.

FIGS. 3*c* and 3*d* illustrate that the bottom right flap 56 is the last bottom flap to be folded over to create the bottom of the outer shell 3. When the bottom right flap 56 is folded over, the right spacer strip 71 of the bottom right flap 56 is folded down along the fold line 64 against the interior of the right side wall 20. The bottom flap 60 is then folded over onto the bottom flaps 52 and 54, thereby creating a third recessed cardboard layer. The tab 60 of the bottom right flap 56 is inserted onto the slot 58 of the bottom left flap 50 to secure the bottom flaps 50, 52, 54, and 56 in place. Thus assembled, the front air aperture 61 and the back air aperture 73 form air vents to permit the circulation of air under the bottom right flap 56. To remove the bottom flaps from the secured position shown in FIG. 3*d*, a user may pull the bottom flap out of its secured position by using the finger flap 63 of the bottom flap 60 or the opening formed by pushing the finger flap 63 inward.

FIGS. 4*a–4f* illustrate the formation of the top and handle 25 of the outer shell 3 of the present invention. FIGS. 4*a* and 4*b* indicate that the top right handle flap 28, which is secured to right side wall panel 20 along top right fold line 76, is folded over into opening 41 in the top so that the top right handle flap 28 is in alignment with the top right fold line 76. FIG. 4*b* illustrates that right handle portion 36 is then folded upward from the top right handle flap 28 so that the right handle portion 36 is perpendicular to the top right handle flap 28.

FIG. 4*c* shows that the top left handle flap 30 is then folded down and the left handle portion 38, which is also folded upright like the right handle portion 36, cooperates with right handle portion 36. The tab 34, which is cutout from underneath the left handle portion 38 is placed through the opening underneath the right handle portion 36 and over the right tab 32. As shown in FIG. 4*d*, the left handle portion 38 is then folded over the right handle portion 36 and the distal tab 34 of the left handle portion 38 is slid under the proximal tab 34 of the left handle portion to form the handle 26 of the outer shell 3. FIG. 4*e* shows top front flap 40 folded over along top front fold line 74 onto the top right handle flap 28 and the top left handle flap 30. The handle 26 is inserted through the open-ended slot 44, thereby allowing the top front flap 40 to rest flat against the right and left handle flaps 28 and 30. As shown in FIG. 4*f*, the top back flap 42 is folded over along top back fold line 78 onto the top front flap 40 and the top right and left handle flaps 28 and 30. The handle 26 is inserted through the slot 44 of the top back flap 42, allowing the top back flap 42 to rest flat against the top front flap 40 and the top right and left handle flaps 28 and 30. The distal locking portion 43 of the top back flap 42 is inserted into the groove formed by the body 92 of the mouth so that the locking portion prevents the mouth from being pulled back into the outer shell 3 by the weight of the liquid when filled. The top front flap 40 and the top back flap 42 lock the handle flaps 28 and 30 in place. Thus assembled, the handle 25 defines a first end proximate the front wall panel 16 and a second end spaced further from the front wall panel than the first end, and the handle defines an opening between first end and the second end sized and shaped to receive the fingers of a hand.

Desirably, the front 13 of the outer shell 3 has a vertical height of roughly 8½ inches and a width of roughly 6⅛ inches. The bottom 23 has a width of roughly 6⅛ inches and a length of roughly 8½ inches. The back 15 of the outer shell has a height of roughly 6 inches and a width of roughly 6¼ inches.

FIGS. 5*a* and 5*b* illustrate the filling of the container 10 of the present invention. FIG. 5*a* is a schematic view illlustrating the compressed, flexible bag 5 located within the outer shell 3 and the container in the "fill" position—namely, held in the right hand of the user with the container 10 resting on its back side wall panel 18 with the front side wall panel 16 facing upwards. The left hand of the user actuates the spigot from the pot. FIG. 5*b* illustrates coffee being poured into the bag 5 through the mouth 7 from a spigot spaced over the mouth 7, thereby forcing the bag to expand. To maximize the volume of liquid that the beverage container 10 may hold, the bag 5 is sized and shaped so that it may expand into the corners of the outer shell 3. Advantageously, the container has a capacity of at least 48 ounces of fluid, desirably, between 70 and 200 ounces of fluid and, most desirably, roughly 96 ounces of fluid.

Since the mouth 7 desirably defines a flow channel having a diameter of at least ¾ inches, desirably at least one inch and most desirably 1¼ inches, the user is able to visually determine when the level of fluid in the bag is proximate the bottom of the mouth 7 and moves the spigot to cut off the flow of fluid into the container 10. The bag 5 is desirably sized such that when the level of fluid in the container is proximate the bottom of the mouth 7 when the container is positioned with its back wall panel 18 faced downward and in a horizontal orientation, when the container 10 is rotated to rest on its bottom 23 with the handle 26 facing up, the level of fluid in the bag 5 is below any opening formed by the spout 9 and, desirably, below the internal flow channel 100 of the mouth 7. This reduces the risk of spilling during transport and the risk of injury to the user from spillage of hot coffee when the spout is opened. Effectively, the bag 5 to "sags" within the outer shell 3 when the container is rotated from its fill position to its "carry" position so that the level of fluid is below the level of the mouth. The volume of fluid in the container when the container is in its fill position and the level of fluid in the container is proximate the bottom of the mouth 7, is referred to as the "normal fill volume."

An important aspect of the invention is that the flaps 40 and 42 provide the advantage of minimizing the load on the handle 26 by transferring the a portion of the load from the weight of the container 10 and the contents from the handle 26 across the flaps 40 and 42. With the handle 25 secured in place, the container 10 may be easily transported and carried like a briefcase. The carrier thus avoids having to hold the outer shell 3 which may be hot from the coffee or other liquid inside by the wall panels.

Yet another important advantage of the invention is that when the container is filled to its normal fill volume and positioned with its bottom facing downward and in a horizontal orientation, the center of gravity CG of the filled container is located at least one-half inch below the vertical center of the container VC (i.e., half-way between the top and bottom of the outer shell) and, preferrably, at least one inches below the center of gravity of the container. This is important to reduce the risk that the container will tip over during transport. In addition, the cross-sectional area of the bottom of the outer shell 3 is desirably as large as any horizontal cross-section of the container to further reduce the risk that the container will tip over when transporting or manipulating the container.

Advantageously, the top of the outer shell 3 ramps upward from the back side wall panel 18 to the front side wall panel 16, which has the opening 48 for a spout. This preferred design facilitates dispensing fluids from the container when a user grips the handle 26 and rotates the container 10 forward to pour the fluid within the container out of the spout 9. Specifically, the amount the user needs to pivot their hand relative the arm to pour is reduced, because the fluid in the container is already tipped toward the spout when the handle is horizontal from the rest position (with the bottom supported on a horizontal surface).

Importantly, by having the bottom of the outer shell 3 configured as shown in FIG. 3*d* with a recessed bottom, only the thin edges formed by the bottom fold lines 82, 84, 86 and 88 contact a support surface when the outer shell 3 is set on in its bottom 23. Because the bottom flaps 50, 52, 54, and 56, are recessed from the bottom 23 of the container, heat is not transfered directly from the bottom flaps to the support surface. The transfer of heat is further reduced by the air vents formed at the front and back of the container. Furthermore, the present invention provides multiple layers of cardboard in bottom flaps 50, 52, 54, and 56, thereby providing extra insulation from the heat. All of this is possible in a low cost container 10 particularly adapted to be constructed of such low cost materials that it can be disposable.

The container 10 is also particularly adapted to be used to mix hot and cold flavored drinks, by means of storing the flavor crystals in the bags 5 of a flattened container until it is desired to add liquid thereto. In this case, the channel 100 of the mouth 7 is desirably sealed by the spout 9 or other means, such as a removable aluminum cover.

Finally, the container 10 is also particularly adapted to be used to heat or cool liquids by placing a source of heat or a cold pack or ice in the outer shell 3 before closing either the top flaps or the bottom flaps of the outer shell. Alternatively, it is possible to insert ice through the mouth 7 into the bag 5, to chill fluid therein.

Those of skill in the art will recognize that there are numerous variations and modifications of this invention which are encompassed by its scope. Accordingly, the foregoing description should be considered illustrative of the invention and not deemed to limit its scope.

What is claimed is:

1. A foldable liquid container, comprising:

an outer shell comprising a first pair of sidewalls aligned generally in the same plane as one another and a second pair of sidewalls aligned generally in the same plane as one another, said outer shell defining an opening in one of said pairs of sidewalls;

a bag within said outer shell defining an aperture;

a mouth secured to said flexible bag surrounding said aperture and defining a fluid passageway, said mouth sized and shaped such that fluid can be poured through said mouth from a source having an outlet spaced above said mouth;

a plurality of upper end flaps secured to said first pair of sidewalls and said second pair of sidewalls;

a plurality of lower end flaps secured to said first pair of sidewalls and said second pair of sidewalls.

2. The container of claim 1, wherein said mouth and said opening sized and shaped such that when said opening is facing upwards the human eye can detect when a level of fluid in the container is approaching the mouth.

3. The container of claim 2, wherein said mouth defines an aperture having a span of at least one inch.

4. The container of claim 2, further comprising a spout removably coupled to said mouth.

5. The container of claim 2, wherein at least one of said plurality of upper end flaps forms at least a portion of a handle when said container is folded.

6. The container of claim 1, wherein said bag and said outer shell are sized and shaped such that when said bag is substantially full of liquid, the center of gravity of said container is located at least one-half inch below said center of said container.

7. The container of claim 1, wherein said bag and said outer shell are sized and shaped such that when said bag is substantially full of liquid, the center of gravity of said container is located at least one inch below said center of said container.

8. The container of claim 1, wherein at least one of said plurality of upper end flaps forms at least a portion of a handle when said container is folded, and said bag and said outer shell are sized and shaped such that when said bag is substantially full of liquid, the center of gravity of said container is located at least one-half inch below said center of said container.

9. A foldable liquid container, comprising:

an outer shell comprising a first pair of sidewalls aligned generally in the same plane as one another and a second pair of sidewalls aligned generally in the same plane as one another, said outer shell defining an opening in one of said pairs of sidewalls;

a bag within said outer shell defining an aperture;

a mouth secured to said flexible bag surrounding said aperture and defining a fluid passageway, said mouth sized and shaped such that fluid can be poured through said mouth from a source having an outlet spaced above said mouth;

a plurality of upper end flaps secured to said first pair of sidewalls and said second pair of sidewalls, wherein at least one of said plurality of upper end flaps forms at least a portion of a handle when said container is folded; and a plurality of lower end flaps secured to said first pair of sidewalls and said second pair of sidewalls, wherein when assembled at least one of said lower end flaps forms a lower panel upon which said bag rests when it is filled with liquid which is spaced above said bottom of said outer shell and said lower end flaps cover said bag from below by three layers.

10. The container of claim 9, wherein said mouth and said opening sized and shaped such that when said opening is facing upwards the human eye can detect when a level of fluid in the container is approaching the mouth.

11. The container of claim 10, wherein said mouth defines an aperture having a span of at least one inch.

12. The container of claim 9, further comprising a spout removably coupled to said mouth.

13. The container of claim 9, wherein said bag and said outer shell are sized and shaped such that when said bag is substantially full of liquid, the center of gravity of said container is located at least one-half inch below said center of said container.

14. The container of claim 9, wherein said bag and said outer shell are sized and shaped such that when said bag is substantially full of liquid, the center of gravity of said container is located at least one inch below said center of said container.

15. A method of using a collapsed liquid container, comprising:

folding said container so that said container defines a top from which a handle extends, a bottom and a mouth defining a fluid flow path communicating with an interior of said container through a sidewall placing the container in a first position with said sidewall facing upward;

pouring fluid through said mouth into said container to at least partially fill said container with fluid;

sealing said mouth after said pouring of fluid into said container; and manually grasping said handle to move said container after said sealing.

16. The method of claim 15, further comprising rotating said container to a second position wherein said handle is on top.

17. The method of claim 16, further comprising applying force to said handle to rotating said container to pour fluid out of said bag through said mouth.

18. The method of claim 15, wherein said sealing step comprises securing a spout over said mouth.

19. The method of claim 18, further comprising rotating said container to a second position wherein said handle is on top.

20. The method of claim 19, further comprising applying force to said handle to rotating said container to pour fluid out of said bag through said mouth.

21. A liquid container comprising:

a compressed outer shell having a top and a bottom side, said outer shell having an opening on a side of said outer shell adjacent to said top side;

a vertical handle extending from said top of said outer shell;

a flexible, collapsed bag within said outer shell, said bag containing crystals; and a spout removably coupled to said opening on said outer shell, said spout in fluid communication with the inside of said bag.

* * * * *

Disclaimer

5,715,992—Jared P. Andrews, Sr., Grand Terrace; John W. Goodin, Coto de Caza, both of Calif. BEVERAGE CONTAINER. Patent dated Feb. 10, 1998. Disclaimer filed October 02, 1998, by the Assignee, J & M Coffee Container Company, Inc.

Hereby enters this disclaimer to claims 9-14, of said patent.

(*Official Gazette May 22, 2007*)